US005865234A

United States Patent [19]

Nakamura et al.

[11] Patent Number: 5,865,234

[45] Date of Patent: Feb. 2, 1999

[54] VERTICAL BLIND

[75] Inventors: Hidehiko Nakamura; Shinichiro Yoshida, both of Tokyo, Japan

[73] Assignee: Kabushiki Kaisha Nichibei, Tokyo, Japan

[21] Appl. No.: 890,681

[22] Filed: Jul. 9, 1997

[30] Foreign Application Priority Data

Aug. 12, 1996 [JP] Japan ..... 8-212782
Nov. 11, 1996 [JP] Japan ..... 8-298520

[51] Int. Cl.[6] ..... E06B 3/48

[52] U.S. Cl. ..... 160/115; 160/176.1 V; 160/900

[58] Field of Search ..... 160/113, 115, 160/180, 179, 168.1 V, 176.1 V, 900

[56] References Cited

U.S. PATENT DOCUMENTS

| | | | |
|---|---|---|---|
| 2,188,575 | 1/1940 | Mclennan | 160/176.1 V X |
| 3,946,789 | 3/1976 | Ronkholz-Tölle, nee T+e,uml +ee lle . | |
| 4,657,061 | 4/1987 | Meier | 160/176.1 V |
| 5,139,071 | 8/1992 | Danchulis | 160/115 |
| 5,558,146 | 9/1996 | Abe | 160/236 X |
| 5,597,026 | 1/1997 | Fuentes et al. | 160/115 |

FOREIGN PATENT DOCUMENTS

| | | | |
|---|---|---|---|
| 0549216 | 6/1993 | European Pat. Off. . | |
| 2691744 | 12/1993 | France . | |
| 2344288 | 3/1974 | Germany | 160/168.1 |

*Primary Examiner*—Blair M. Johnson
*Attorney, Agent, or Firm*—Greenblum & Bernstein, P.L.C.

[57] ABSTRACT

A vertical blind that includes a plurality of louvers of which certain louvers are alternately positioned and can be placed in various positions so that the vertical blind can be fully changed in form. The vertical blind further includes a rotation-transferring mechanism on alternating carriers. The rotation-transferring mechanism serves to transfer the rotation of the shaft, which is mounted in the head rail, to the louvers, which are hung from the alternating carriers, so that the louvers rotate around their vertical axes. If the louvers that are hung from the carriers with the rotation-transferring mechanism are positioned so that they are almost perpendicular to the head rail, each louver hung from those carriers that are not equipped with a rotation-transferring mechanism almost covers each space left between the louvers on either side of the louver hung from the carrier with the rotation-transferring mechanism.

22 Claims, 15 Drawing Sheets

VERTICAL BLIND

BACKGROUND OF THE INVENTION

1. Field of the Invention

The present invention relates to a vertical blind.

2. Background Information

A conventional vertical blind is known in the art that includes a head rail and plural movable carriers arranged within the head rail. The conventional vertical blind further includes louvers that are hung from the carriers, rotation shafts that are mounted in the head rail, and a rotation-transferring mechanism for transferring the motion of the rotation shafts to the louvers, which, in turn, rotate about their vertical axes. When the blind is opened, the louvers are folded at the end of the head rail. The vertical blind is closed by moving plural carriers. The louvers hung from the carriers are turned as one unit by turning the rotation shafts. If all the louvers are oriented nearly parallel to the head rail, the louvers are in a screening state and screen the view from the inside. If the louvers are oriented nearly perpendicular to the head rail, the louvers do not screen the view and are in a viewing state. The vertical blind is used by alternating between the screening state and the viewing state.

However, this conventional vertical blind is disadvantageous because all the louvers simultaneously perform the same movements. The movement and shape of the blind, thus, is monotonous.

The conventional vertical blind is further disadvantageous because, when in the viewing state, all the louvers are oriented nearly perpendicular to the head rail. Thus, light from the outside can enter the inside of the room. Moreover, the interior of the room is fully exposed to view through the louvers from the outside. Thus, privacy cannot be guarded.

The present invention seeks to overcome such disadvantages. It is an object of the present invention to provide a vertical blind where alternating louvers can be placed in a different position from those louvers adjacent to the alternating louvers. Thus, the vertical blind has a variety of shapes.

Further, it is another object of the present invention to provide a vertical blind in which light can enter the room from the outside without fully exposing the interior of the room to viewing from the outside through the louvers.

Another object of the present invention is to provide a vertical blind in which the louvers automatically restore to their original position after the louvers have been flapped by the wind or like. Thus, the inside of the room is not fully exposed to view from the outside of the room.

SUMMARY OF THE INVENTION

A vertical blind according to the present invention includes a head rail, plural movable carriers arranged in the head rail, and louvers hung from the respective carriers. The vertical blind further includes a rotation-transferring mechanism provided on alternating carriers (first carriers) of the plural carriers. The rotation-transferring mechanism serves to transfer the motion of the driver, that is mounted in the head rail, to those louvers hung from the first carriers. The transferred motion rotates the louvers hung from the first carriers about the vertical axis of the louvers. Thus, if the louvers hung from the first carriers have been turned so that the louvers are oriented almost perpendicular to the head rail, the louvers hung from the carriers with no rotation-transferring mechanism (second carriers) are able to maintain a position that covers the space between the louvers hung from the first carriers, which are adjacent to both sides of the louver hung from the second carrier.

Preferably, if the carriers are arranged in a spaced state, where the plural carriers are disposed at given intervals between each other, the louvers hung from the second carriers may always be maintained such that the louvers hung from the second carriers are oriented parallel to the head rail.

Preferably, when the louvers hung from the first carriers are oriented almost perpendicular to the head rail, the width of each louver hung from an individual second carrier is larger than the distance between both louvers hung from the first carriers adjacent to the louver hung from a second carrier.

Another vertical blind according to the present invention includes a head rail, plural movable carriers arranged within the head rail, and louvers hung from the respective carriers. The vertical blind further includes first rotation-transferring mechanisms on alternating carriers (first carriers) of the plural carriers. The first rotation-transferring mechanisms serve to transfer the motion of the first driver mounted in the head rail to the louvers hung from the first carriers. The transferred motion turns the louvers hung from a first carrier about the vertical axis of the louvers. The second rotation-transferring mechanism is provided only in the second carriers, those carriers without a first rotation-transferring mechanism. The second rotation-transferring mechanism serves to transfer the motion of a second driver mounted in the head rail to the louvers hung from the second carriers. The transferred motion turns the louvers hung from the second carriers about the vertical axis of louvers. Thus, if the louvers hung from the first carriers have been turned so that they are almost perpendicular to the head rail, the louvers hung from the second carriers can almost cover each space that remains between both louvers hung from the first carriers adjacent to each side of the louver hung from the second carrier.

Yet another vertical blind according to the present invention includes a head rail, plural movable carriers arranged in the head rail, and louvers hung from the respective carriers. The vertical blind further includes a first rotation-transferring mechanism in alternating carriers (first carriers) out of the plural carriers. The first rotation-transferring mechanism serves to transmit the motion from a first driver mounted in the head rail to the louvers hung from the first carriers. The transferred motion turns the louvers hung from the first carriers about the vertical axes of the louvers. A second rotation-transferring mechanism is provided in all the carriers and serves to transfer the motion of a second driver mounted in the head rail to the louvers hung from all the carriers. The transferred motion rotates the louvers hung from all the carriers about the vertical axis of the louvers. Thus, when the louvers hung from the first carriers have been turned so that the louvers are nearly perpendicular to the head rail, the louvers hung from the second carriers, those carriers without the first rotation-transferring mechanism, can remain in place and cover most of each space remaining between both louvers hung from the first carriers adjacent to both sides of the louver hung from the second carrier.

Another vertical blind according to the present invention includes a head rail, plural movable carriers arranged in the head rail and louvers hung from the respective carriers. The vertical blind further includes a first rotation-transferring mechanism provided in all the carriers. The first rotation-transferring mechanism transfers a movement of a first driver mounted in the head rail to the louvers hung from the plural carriers. The transferred motion turns the louvers hung from all the plural carriers about the vertical axis of the louvers. A second rotation-transferring mechanism is provided only in alternating carriers (second carriers) out of the plural carriers. The second rotation-transferring mechanism serves to turn the louvers hung from the second carriers about the vertical axis of the louver by transferring the movement of a second driver mounted in the head rail to the louvers hung from the second carriers. Thus, if the louvers hung from the first carriers, those carriers not equipped with a second rotation-transferring mechanism, have been rotated to that the louvers are almost perpendicular to the head rail, each louver hung from the second carriers can almost cover each space left between both louvers hung from the first carriers that are adjacent to each louver hung from each of the second carriers.

Another vertical blind according to the present invention includes a head rail, plural movable carriers arranged in the head rail and louvers hung from the respective carriers. The vertical blind further includes a rotation-transferring mechanism provided on alternating carriers (first carriers) out of the plural carriers. The rotation-transferring mechanism serves to transfer the movement of a driver mounted in the head rail to louvers hung from the first carriers. The transferred motion turns the louvers hung from the first carriers about vertical axis of louvers. Thus, the group of louvers hung from the first carriers and the group of louvers hung from the second carriers, which are not provided with a rotation-transferring mechanism, can be maintained at different turning angles to each other.

Alternating louvers can be positioned differently from the louvers adjacent to the alternating louvers. For example, alternating louvers can be oriented perpendicularly to the head rail while the remaining louvers are not so oriented. Thus, the vertical blind has a full variety of shapes.

Preferably, the above louvers hung from the second carriers may be semitransparent. Because the spaces between the louvers which are oriented perpendicular to the head rail are covered by semitransparent louvers, light from the outside of the room can reach the inside of the room. Thus, one can view the outside from the inside without fully exposing the inside of the room to viewing from outside. Thus, privacy can be guarded to some extent.

Preferably, where the louvers hung from the first carriers have been oriented nearly parallel to the head rail, no space can be seen from the direction perpendicular to the head rail between both louvers hung from the adjoining first carriers. Thus, in this instance, the louvers hung from the first carriers effectively perform the screening function of the vertical blind.

Another embodiment of the invention is a vertical blind that includes a head rail, plural movable carriers arranged in the head rail and louvers hung from the respective carriers. The vertical blind further includes a rotation-transferring mechanism on alternating carriers (first carriers). The rotation-transferring mechanism turns the louvers hung from the first carriers about the vertical axis of the louvers by transferring the movement of a driver mounted in the head rail to the louvers. The vertical blind of this embodiment further includes a device in the second carriers, those carriers without the rotation-transferring mechanism, that forces the louvers hung from the second carriers in a given turning direction about the vertical axis of the louvers. Thus, if the louvers hung from the first carriers have been turned to be oriented nearly perpendicular to the head rail, each louver hung from an individual second carrier can maintain its position whereby each louver hung from the individual second carrier almost covers each space left between both louvers hung from the first carriers adjacent to both sides of each louver hung from the individual second carrier. Accordingly, when louvers hung from the first carriers are turned so that they face away from the louvers hung from the second carriers, space cannot form between the louvers hung from the first carriers and the louvers hung from the second carriers. Further, even if the louvers hung from the second carriers are about to be turned about their vertical axes by force of the wind, if the louvers hung from the second carriers are positioned to almost cover each space between the adjacent louvers from the first carriers, the louvers hung from the second carriers can almost be restored by action of the forcing device.

Preferably, the width of each louver hung from the individual second carrier is larger than the distance between both louvers hung from the first carriers that adjoin each other, where the louvers hung from the first carriers have been turned until they are nearly perpendicular to the head rail. Accordingly, although louvers hung from the second carriers are always forced by the force driver to rotate about their vertical axes in a given direction, the louvers hung from the second carriers are prevented from rotating by the louvers hung from the first carriers. Thus, if the louvers hung from the second carriers can be oriented at a certain angle against the head rail, each louver hung from an individual second carrier can almost cover each space between both louvers hung from the adjacent first carriers. Further, when the vertical blind is opened, the louvers hung from the second carriers, which are oriented perpendicular to the head rail, are pushed by the louvers hung from the first carriers. Because the louvers hung from the second carriers are oriented at a certain angle against the head rail, the louvers hung from the second carriers can be turned without one louver catching another louver.

Preferably, the louvers hung from the second carriers may be semitransparent. Because each semitransparent louver covers the space between the two adjacent louvers, which are turned perpendicular to the head rail, light can reach the inside from the outside of the room and one can see out of the vertical blind. Additionally, privacy is guarded to some extent because the inside of the room is not fully exposed to viewing through the louvers from the outside of a room.

Preferably, where the louvers hung from the first carriers have been rotated until they are parallel to the head rail, no space between both adjoining louvers hung from the first carriers may be seen from a direction perpendicular to the head rail. Accordingly, the louvers hung from the first carriers perform the screening function of the vertical blind.

In one preferred embodiment of the invention, the vertical blind includes a head rail having a longitudinal axis and a plurality of first and second carriers that are alternately spaced and movable within the head rail. The vertical blind further includes a louver hung from each of the first and second carriers. The vertical blind further includes a rotation-transferring mechanism on the first carriers for rotating the louvers hung from the first carriers such that the louvers hung from the first carriers rotate about the vertical axes of the louvers. Thus, the louvers hung from the second carriers are able to cover the space between the louvers hung from the first carriers when the louvers hung from the first carriers are oriented perpendicular to the longitudinal axis of the head rail.

Another aspect of this embodiment includes a vertical blind wherein the first and second carriers are arranged such that, when the first and second carriers are spaced at predetermined intervals, the louvers hung from the second carriers are always positioned parallel to the longitudinal axis of the head rail.

In another aspect of this embodiment, the width of the louvers hung from the second carriers is greater than the distance between the louvers hung from the first carriers adjacent to the louvers hung from the second carriers, when the louvers hung from the first carriers are oriented substantially perpendicular to the longitudinal axis of the head rail.

In another aspect of this embodiment, the louvers hung from the second carriers are semitransparent.

In another aspect of this embodiment, the louvers hung from the first carriers completely cover the space between the louvers hung from the first carriers when the first carriers are oriented substantially parallel to the longitudinal axis of the head rail.

Another embodiment of the present invention includes a vertical blind that includes a head rail having a longitudinal axis, a plurality of first and second carriers alternately spaced and movable within the head rail, and a first driver mounted within the head rail. The vertical blind further includes a louver hung from each of the first and second carriers. The vertical blind further includes a first rotation-transferring mechanism on each of the first carriers for transferring the motion of a first driver to the louvers hung from the first carriers to rotate the louvers about the vertical axes of the louvers. The vertical blind further includes a second driver mounted within the head rail and a second rotation-transferring mechanism on each of the second carriers for transferring the motion of the second driver to the louvers hung from the second carriers to rotate the louvers about the vertical axis of the louvers. The second rotation-transferring mechanism is independently operated from the first rotation-transferring mechanism. Thus, the louvers hung from the second carriers are able to cover the space between the louvers hung from the first carriers when the louvers hung from the first carriers are oriented perpendicular to the longitudinal axis of the head rail.

In another aspect of this invention, the louvers hung from the second carriers are semitransparent.

In another aspect of this invention, the louvers hung from the first carriers completely cover the space between the louvers hung from the first carriers when the first carriers are oriented substantially parallel to the longitudinal axis of the head rail.

Another embodiment of the invention includes a vertical blind that includes a head rail having a longitudinal axis, a plurality of first and second carriers alternately spaced and movable within the head rail, a first driver mounted within the head rail and a louver hung from each of the first and second carriers. The vertical blind further includes a first rotation-transferring mechanism on each of the first carriers for transferring the motion of the first driver to the louvers hung from the first carriers to rotate the louvers about the vertical axis of the louvers. The vertical blind of the present embodiment further includes a second driver mounted within the head rail and a second rotation-transfening mechanism on each of the first and second carriers for transferring the motion of the second driver to the louvers hung from the first and second carriers to rotate the louvers about the vertical axes of the louvers. The second rotation-transferring mechanism is independently operated from the first rotation-transferring mechanism. Thus, the louvers hung from the second carriers are able to cover the space between the louvers hung from the first carriers when the louvers hung from the first carriers are oriented perpendicular to the longitudinal axis of the head rail.

In another aspect of this invention, the louvers hung from the second carriers are semitransparent.

In another aspect of this invention, the louvers hung from the first carriers completely cover the space between the louvers hung from the first carriers when the first carriers are oriented substantially parallel to the longitudinal axis of the head rail.

In another embodiment of the invention, the vertical blind includes a head rail having a longitudinal axis, a plurality of first and second carriers alternately spaced and movable within the head rail, a first driver mounted within the head rail, and a louver hung from each of the first and second carriers. The vertical blind of the present embodiment further includes a first rotation-transferring mechanism on each the first and second carrier for transferring the motion of the first driver to the louvers hung from the first and second carriers to rotate the louvers about a vertical axis of the louvers. The vertical blind further includes a second driver mounted within the head rail and a second rotation-transferring mechanism on each the second carrier for transferring the motion of the second driver to the louvers hung from the second carriers to rotate the louvers about the vertical axis of the louvers. The second rotation-transferring mechanism is independently operated from the first rotation-transferring mechanism. Thus, the louvers hung from the second carriers are able to cover the space between the louvers hung from the first carriers when the louvers hung from the first carriers are oriented perpendicular to the longitudinal axis of the head rail.

In another aspect of the present embodiment, the louvers hung from the second carriers are semitransparent.

In another aspect of the present embodiment, the louvers hung from the first carriers completely cover a space between the louvers hung from the first carriers when the first carriers are oriented substantially parallel to the longitudinal axis of the head rail.

Another embodiment of the present invention includes a vertical blind including a head rail having a longitudinal axis, a plurality of first and second carriers alternately spaced and movable within the head rail, a driver mounted within the head rail, and a louver hung from each of the first and second carriers. The louvers hung from the second carriers and the louvers hung from the first carriers can be maintained at different turning angles relative to each other. The vertical blind of the present embodiment further includes a rotation-transferring mechanism on each of the first carriers for transfening the motion of the first driver to the louvers hung from the first carriers to rotate the louvers about a vertical axis of the louvers.

In another aspect of the present embodiment, the louvers hung from the second carriers are semitransparent.

In another aspect of the present invention, the louvers hung from the first carriers completely cover a space between the louvers hung from the first carriers when the first carriers are oriented substantially parallel to the longitudinal axis of the head rail.

Another aspect of the present invention includes a vertical blind including a head rail having longitudinal axis, a plurality of first and second carriers alternately spaced and movable within the head rail, a driver mounted within the head rail and a louver hung from each of the first and second carriers. The vertical blind further includes a rotation-transferring mechanism on each of the first carriers for transferring the motion of the driver to the louvers hung from the first carriers to rotate the louvers about a vertical axis of the louvers, and a forcing mechanism mounted within each second carrier for forcing the louvers hung from the second carriers in a given turning direction about a vertical axis of said louvers. Thus, the louvers hung from the second carriers are able to cover a space between the louvers hung from the first carriers when the louvers hung from the first carriers are oriented perpendicular to the longitudinal axis of the head rail.

In another aspect of the present embodiment, the width of each of the louvers hung from each of the second carriers is greater than the distance between the louvers hung from the first carriers that are adjacent to the louver hung from the second carrier when the louvers hung from the first carriers are oriented substantially perpendicular to the longitudinal axis of the head rail.

In another aspect of the present embodiment, the louvers hung from the second carriers are semitransparent.

In another aspect of the present embodiment, no space can be seen from a direction perpendicular to the longitudinal axis of the head rail between the louvers hung from the first carriers when the louvers hung from the first carriers are oriented substantially parallel to the longitudinal axis of the head rail.

BRIEF DESCRIPTION OF THE DRAWINGS

The invention will be better understood by referring to the description which follows with reference to the drawings, which illustrate by way of non-limiting examples, embodiments of the invention wherein.

DETAILED DESCRIPTION OF THE PREFERRED EMBODIMENTS

The preferred embodiments of the invention are illustrated in detail as follows, referring to appended drawings.

Figure 1:
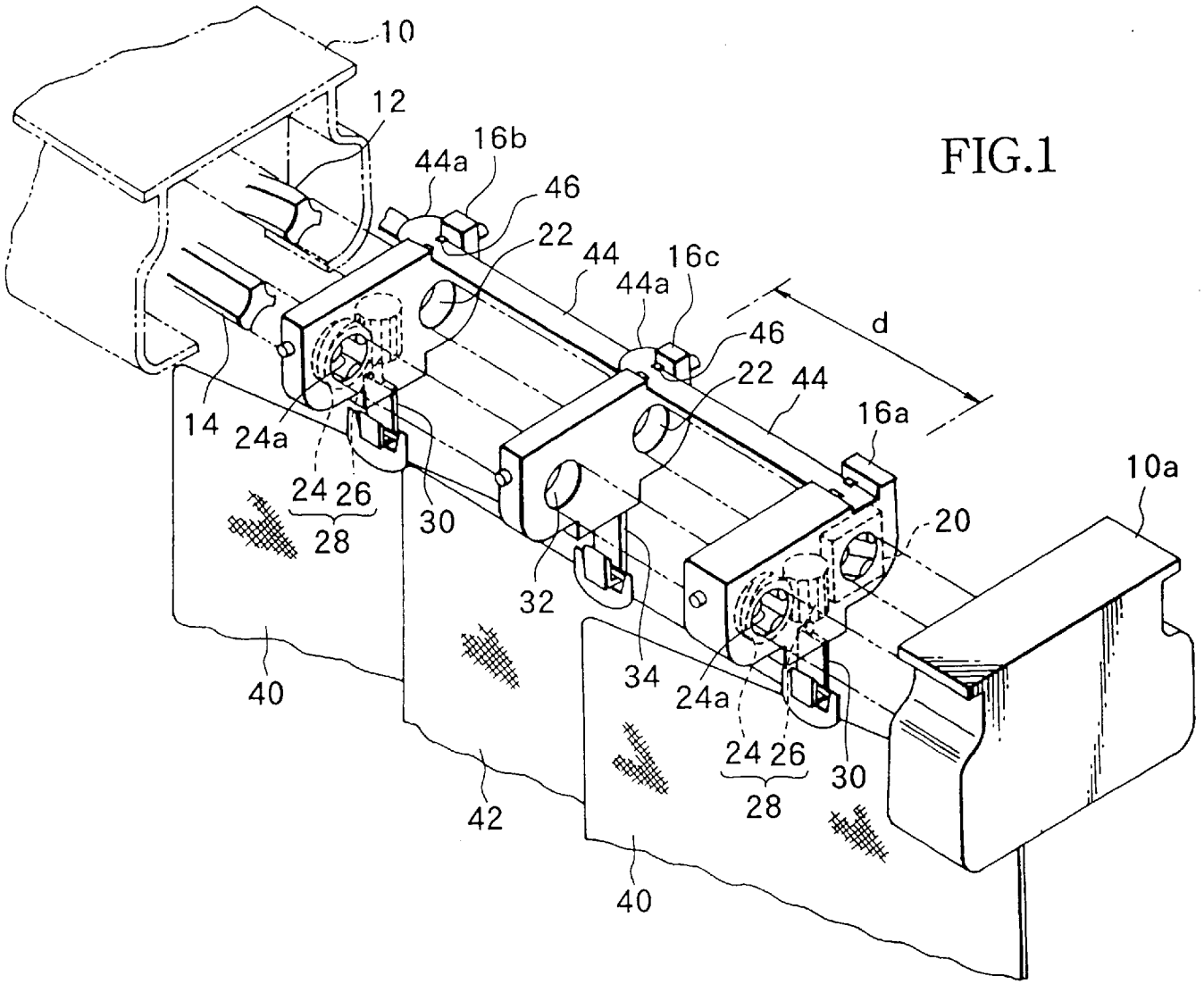
FIG. 1 is a perspective view of a part of a first embodiment of a vertical blind of the present invention, showing all the louvers oriented to a head rail.
Figure 3:
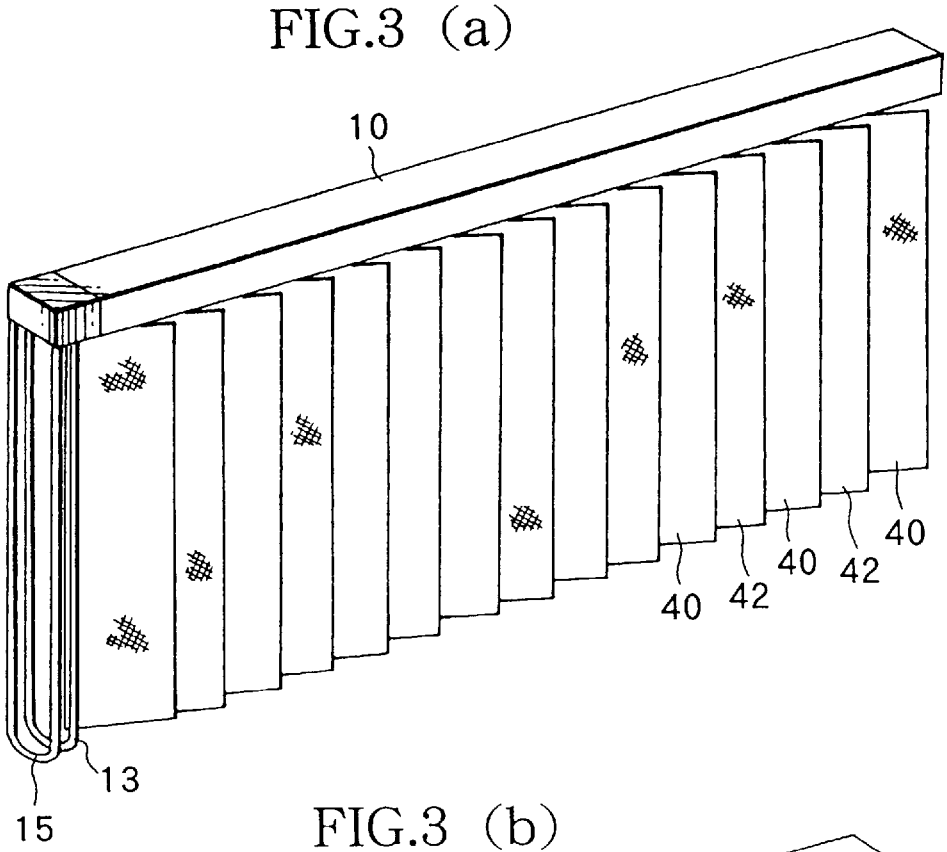
FIGS. 3(*a*) and 3(*b*) are general views showing patterns of motion of a vertical blind of the first embodiment.
Figure 3:
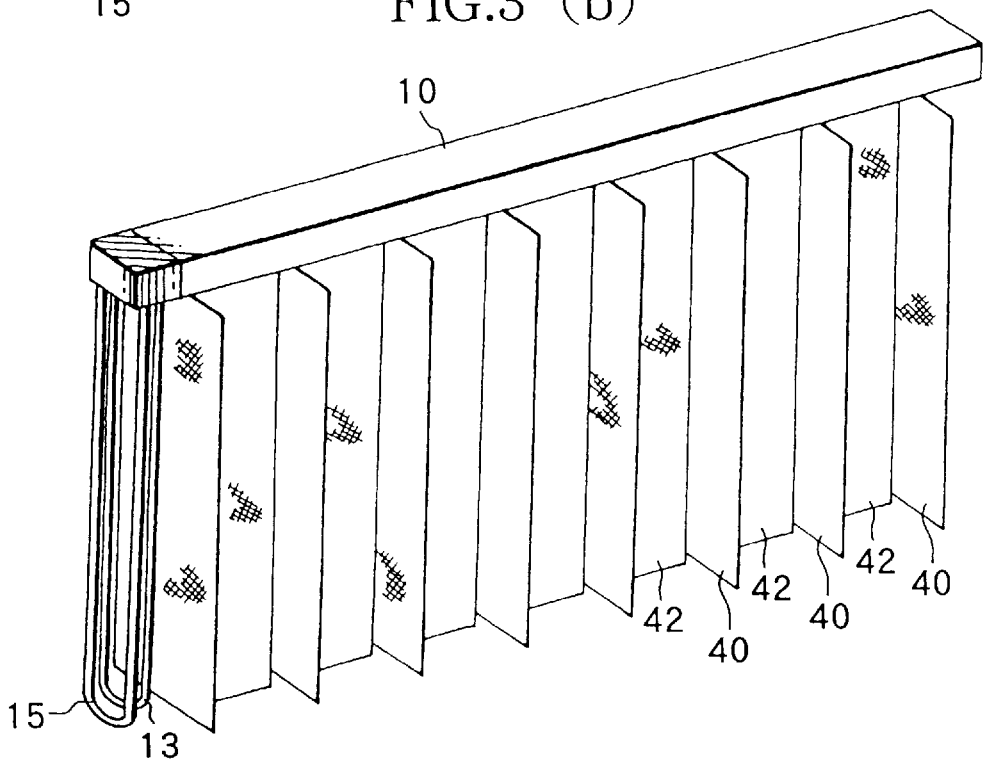

As shown in FIG. 1, the vertical blind of the present invention includes a head rail 10 which has a bottom with a longitudinal opening in the central portion. The head rail 10 further includes an open-and-close shaft 12 and a rotation shaft 14 that are arranged in the longitudinal direction in the head rail 10, and rotatably supported by means of bearings (not shown) provided at either end of the head rail 10. A male screw portion is formed on the outer surface of the open-and-close shaft 12. Three grooves extending in the longitudinal direction are formed on the outer surface of rotation shaft 14. Further, one end of the open-and-close shaft 12 and one end of the rotation shaft 14 are connected to an operation wheel (not shown) that is mounted within the control unit. The control unit is disposed at one end of the head rail 10, so that the open-and-close shaft 12 and the rotation shaft 14 can be rotated by rotating the operation wheel by the operation cords 13, 15 (as shown in FIG. 3(*a*)) which are wound on the operation wheel.

Further, plural carriers are arranged within the head rail 10 and are movable in the longitudinal direction. The endmost carrier of the plural carriers is the master carrier 16*a*. The master carrier 16*a* includes a lead nut 20 through which the open-and-close shaft 12 passes. The lead nut 20 includes a female screw portion which engages with the male screw portion of the open-and-close shaft 12. Each of the carriers, except the master carrier 16*a*, includes a through hole 22 through which the open-and-close shaft 12 loosely passes.

Further, each alternating carriers 16*b* (first carriers), and the master carrier 16*a*, includes a rotation-transferring mechanism 28. The rotation-transferring mechanism includes a worm 24 having a central hole 24*a* with ribs engaged with the grooves of the rotation shaft 14, and a worm wheel 26. The worm wheel 26 engages with the worm 24 inside each first carrier 16*b*. The lower part of the worm wheel 26 is connected with a hook 30. The worm wheel 26 and the hook 30 are able to be rotated as one unit and project downward from carriers 16*b*, 16*a* .

Each of second carriers 16*c*, which have no rotation-transfening mechanism 28, includes a through hole 32 through which the rotation shaft 14 loosely passes, and a hook 34. The hook 34 extends downward and is able to be rotated on a vertical axis relative to second carrier 16*c*.

Opaque louvers 40 are hung from each first carrier 16*b*, which alternate with second carriers 16*c*, including the master carrier 16*a*, through hooks 30. Semitransparent louvers 42 are hung from the second carriers 16*c* through hooks 34.

The carriers are arranged with the master carrier 16*a* at the head. The space between the carriers can be increased or decreased up to a given maximum distance d. The distance d is determined by a spacer link 44, which is a distance-maintaining device.

In FIG. 1, 10*a* designates an end cover of the head rail 10.

In the vertical blind constructed as discussed above, where the respective louvers 40, 42 are oriented parallel to the head rail 10, the open-and-close shaft 12 is rotated by operating the operation cord 13. Operating the operation cord 13 causes the master carrier 16*a*, which includes a lead nut 20 having a female screw portion engaged with a male screw portion of the open-and-close shaft 12, to be moved in the longitudinal direction within the head rail 10. When the distance between the master carrier 16*a* and the next carrier 16*c* reaches a given distance d, the expanding portion 44*a*, which is provided on one end of the spacer link 44, engages the claw portion 46 of the next carrier. The spacer link 44 is connected at another end to the master carrier 16*a*. The claw portion 46 engages with the expanding portion 44*a* and causes the next carrier 16*c* to be drawn. The remaining carriers, which alternate 16*b*, 16*c*, 16*b*, 16*c* etc., are successively drawn.

In this embodiment, the carriers can be arranged to be a given distance apart. Under these conditions, the rotation shaft 14 is rotated by operating the operation cord 15. The movement of the rotation shaft 14 is transferred through the rotation-transferring mechanism 28 that engages the rotation shaft 14. The rotation-transferring mechanism 28 is provided only to the master carrier 16*a* and to the first carriers 16*b*. The hooks 30 and the louvers 40 are turned about their respective vertical axes.

Figure 2:
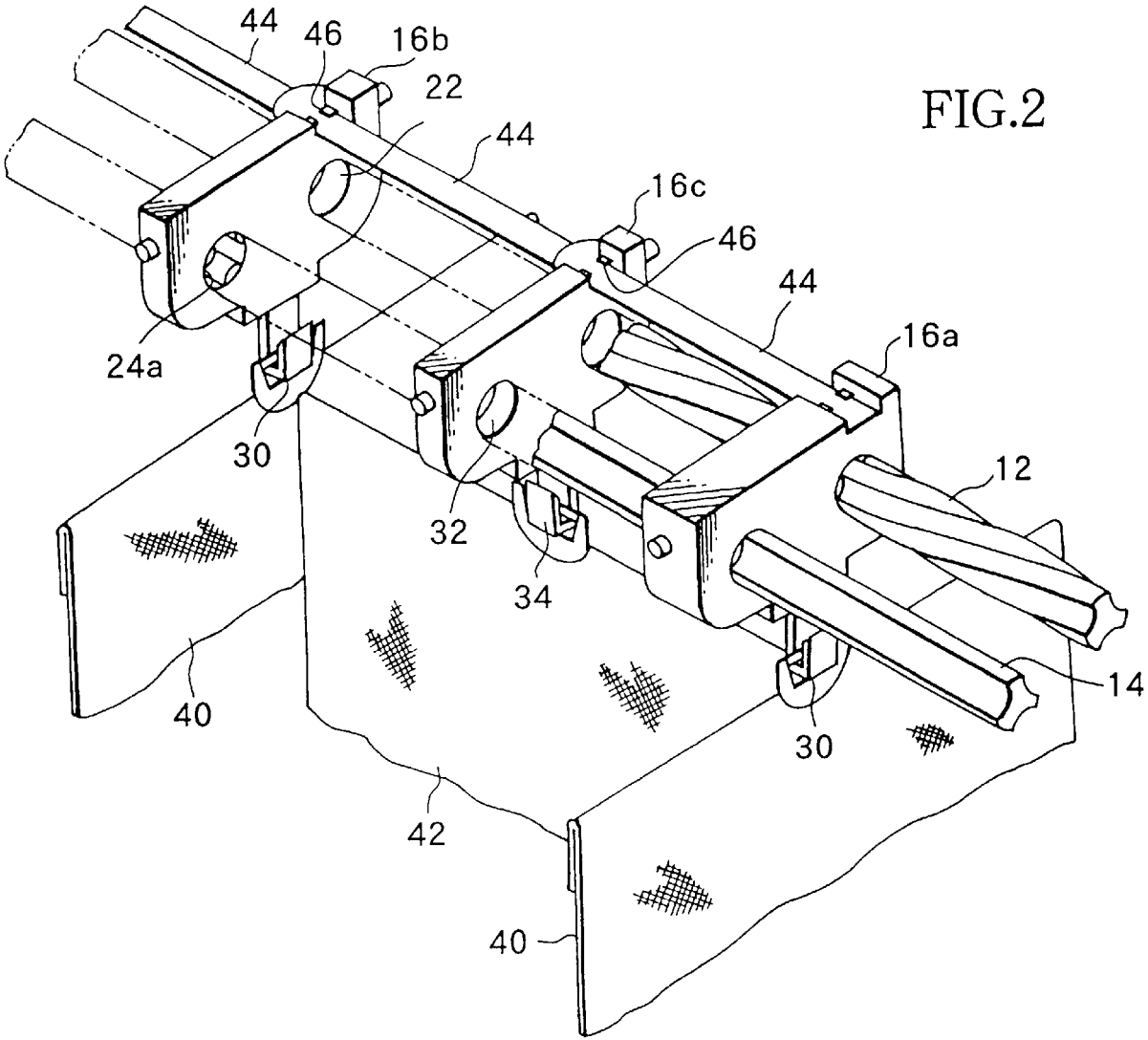
FIG. 2 is a perspective view of a part of the first embodiment of a vertical blind of the present invention, showing the louvers hung from the first carriers oriented to a head rail.

FIGS. 2, 3(*b*) and 5(*a*) show the louvers 40 when they are turned until the louvers 40 are oriented perpendicular to the head rail 10 and the louvers 42 remain oriented parallel to the head rail 10. The louver 42 almost covers the space between both louvers 40 that are on either side of the louver 42. Because the louvers 42 are semitransparent, light can penetrate from the opposite side of a vertical blind and one can see through the louvers 42. One's privacy can be guarded to some degree, however, because the interior of the room is not fully exposed to view through the louvers 42.

Further, FIGS. 1, 3(*a*) and 5(*b*) show the louvers 40 turned until the louvers 40 are oriented parallel to the head rail 10. In this state, there is no space between the louvers 40 that are next to each other. The louvers 40 completely overlap the louvers 42 that are between the louvers 40. Because the louvers 40 are opaque, the vertical blind shields the interior of the room from view.

Figure 4:
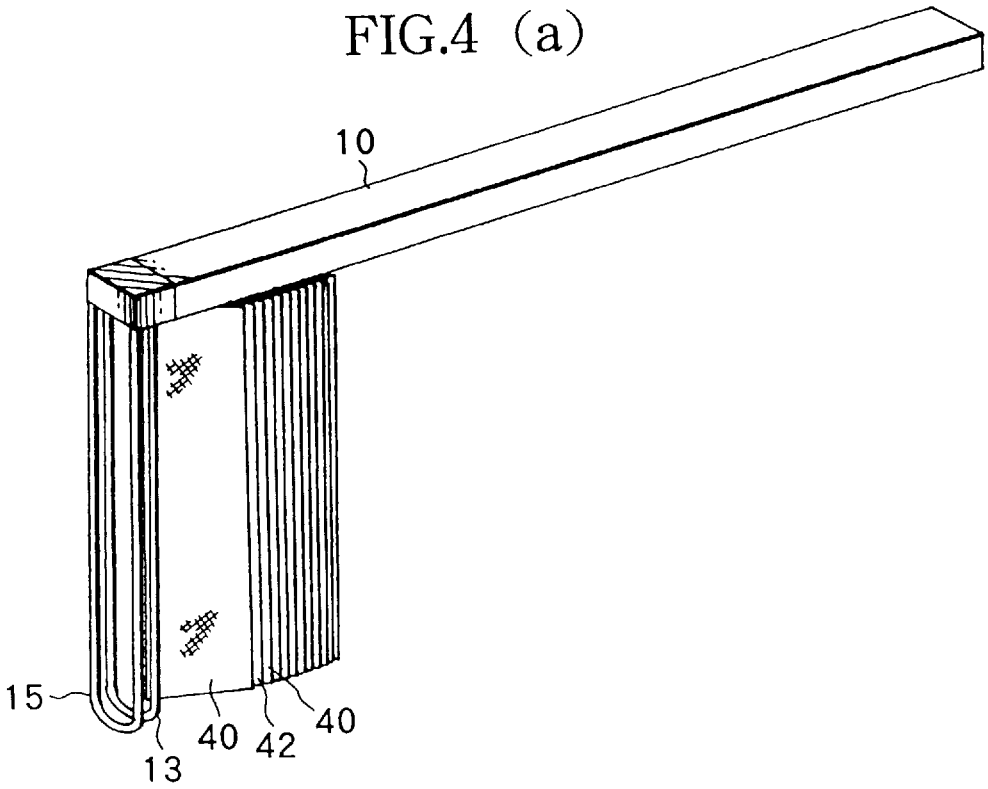
FIGS. 4(*a*) and 4(*b*) are general views showing patterns of motion of a vertical blind of the first embodiment.
Figure 4:
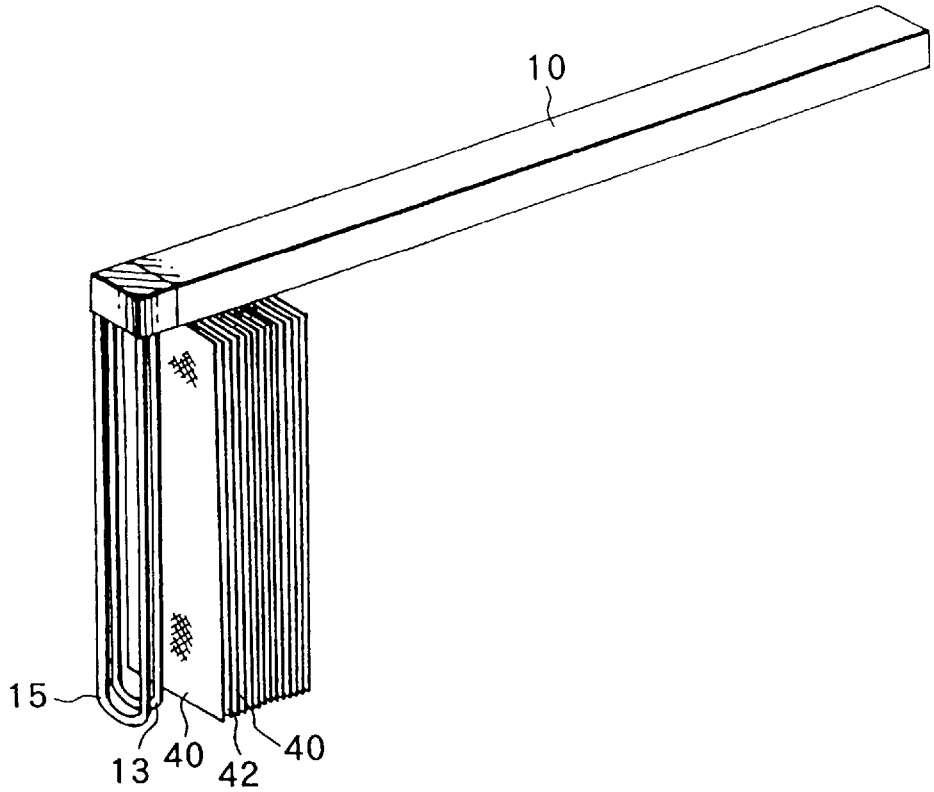

When it is desired to open the vertical blind, if the louvers 40, as shown in FIGS. 3(*a*), and 5(*b*), are oriented parallel to the head rail 10, the open-and-close shaft 12 is rotated in the opposite direction by operating the operation cord 13. Operating the operation cord 13 moves the master carrier 16*a* in the opposite direction of the moving direction. Thus, expanding portions 44*a* of the spacer link 44, having one end secured to master carrier 16*a*, are disengaged from the claw portions 46 of the next carrier 16*c*. The space between the master carrier 16*a* and the next carrier becomes smaller until the master carrier 16*a* contacts the next carrier 16*c*, and pushes the next carrier 16*c* in the same direction as the moving direction of master carrier 16*c*. In the same way, alternating carriers 16*b*, 16*c*, etc . . . are pushed in succession. As a result, louvers 40, 42 overlap each other such that louvers 40, 42 are oriented nearly parallel to or incline slightly against the head rail 10 at the end of the head rail 10, as shown in FIG. 4(*a*) and FIG. 5(*c*). At this point, the rotation shaft 14 is rotated by operating the operation cord 15. The movement of the rotation shaft 14 is transferred through the rotation-transfening mechanism 28 to the louvers 40, which are then turned until the louvers 40 are oriented perpendicular to the head rail 10. The louvers 42 are between the louvers 40 and are hung through the hook 34 from the carriers 16*c*. The louvers 42 are able to be rotated around their vertical axes and are turned together with louvers 40 so that the louvers 42 are oriented perpendicular to the head rail 10. The master carrier 16*a* is then moved to the end of the head rail 10 as far as possible by again operating the operation cord 14, by which all carriers are compactly gathered at one end of the head rail 10.

When closing the vertical blind, the louvers 40, 42 are initially oriented parallel to the head rail 10. Thereafter the carriers must be moved in the longitudinal direction.

Figure 5:
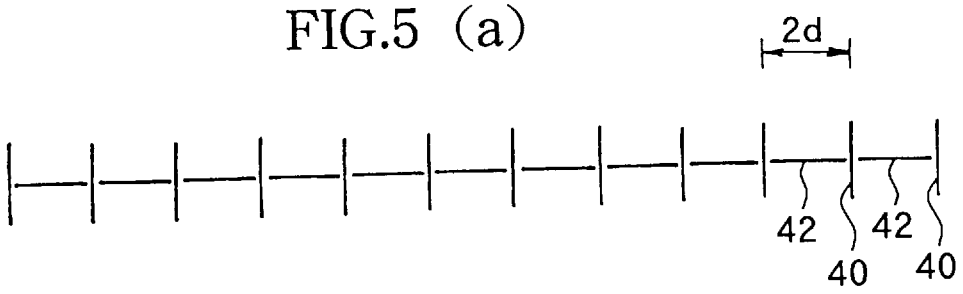
FIGS. 5(*a*), 5(*b*), 5(*c*) and 5(*d*) are diagrams of louvers shown in FIG. 3(*a*), 3(*b*), 4(*a*), and 4(*b*)
Figure 5:
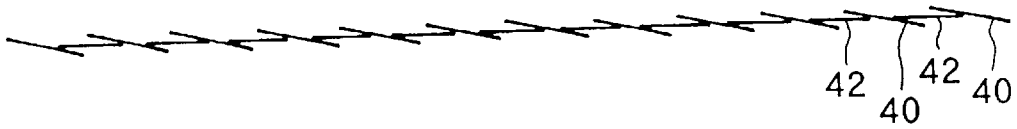
Figure 5:
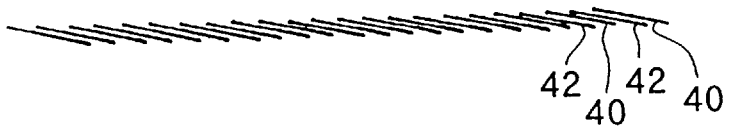
Figure 5:
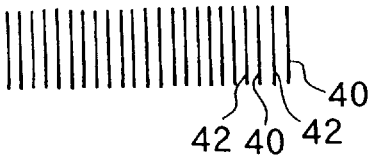

One preferred embodiment in opening and closing the vertical blind is described in the succession of FIG. 5(*d*) →FIG. 5(*c*)→FIG. 5(*b*)→FIG. 5(*a*)⇆FIG. 5(*b*)→FIG. 5(*c*) →FIG. 5(*d*).

As described above, in this preferred embodiment, louvers 40 and louvers 42 can be kept at rotation angles about their vertical axes that differ with respect to each other. Thus a change in the shape of the blind can be effected.

In this embodiment of the invention, the width of the louvers 42 is chosen to be approximately twice the given maximum interval d between the carriers, as determined by the spacer link 44. Accordingly, when the carriers are in the spaced condition, whereby the carriers have traveled within the head rail 10 until the interval between the carriers becomes the maximum interval d as determined by spacer link 44, between the next carrier, and the carriers have stopped leaving space d in the head rail 10, the space between the adjoining louvers 40 can be covered by the louvers 42. The louvers 42 are always positioned parallel to the head rail 10.

Similarly, the width of the louvers 40 is chosen so that it is approximately twice the given interval d between the carriers as determined by spacer link 44. Accordingly, if the carriers are spaced so that the carriers 16 have traveled in the head rail 10 until the interval between the carriers becomes the maximum interval d, as determined by spacer link 44, between the carriers, and if the louvers 40 are turned parallel to the head rail 10, no space between the adjacent louvers 40 can be seen from a direction perpendicular to head rail 10. Thus, the opposite side of the vertical blind can be covered by the opaque louvers 40.

Figure 6:
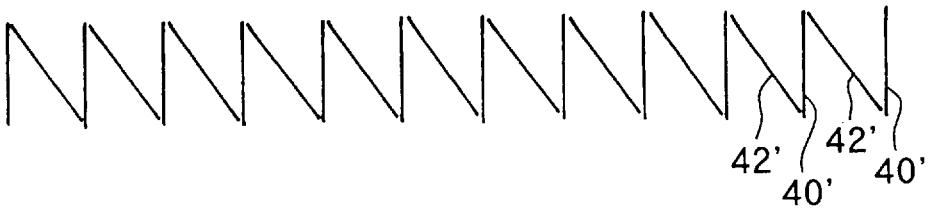
FIGS. 6(*a*), 6(*b*), 6(*c*), 6(*d*) and 6(*e*) are general views showing patterns of motion of a second embodiment of a vertical blind of the present invention.
Figure 6:
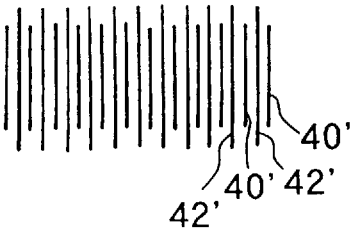
Figure 6:
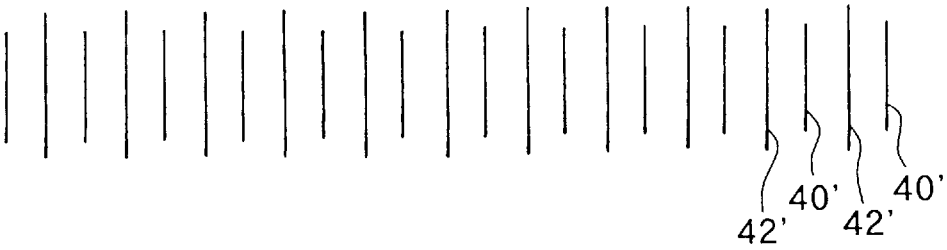
Figure 6:
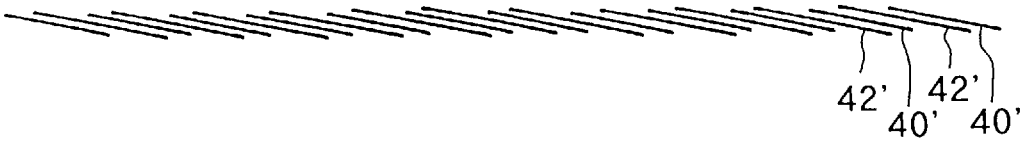
Figure 6:
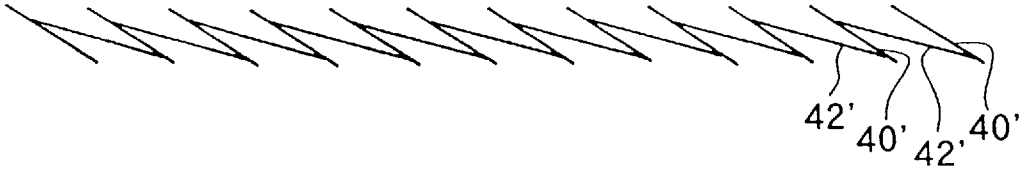

A second embodiment of the present invention is shown in FIGS. 6(*a*)–6(*e*). In this embodiment, the opaque louver 40' is hung from each carrier 16*b* which includes a rotation-transferring mechanism 28. In this embodiment, the width of the opaque louvers 40' is larger than the width in the first embodiment. Specifically, the width of the opaque louvers 40' is larger than twice the given interval d between carriers, as determined by spacer link 44.

Further, the width of the semitransparent louvers 42' hung from each carrier that is not provided with a rotation-transfening mechanism 28, are chosen to be larger than that in the first embodiment. The width of the semitransparent louvers 42' is larger than the distance between both louvers 40' when the louvers 40' are oriented perpendicular to the head rail 10. Specifically, the width is more than twice the given maximum interval d between the carriers, as determined by spacer link 44.

Other than the those elements of the present embodiment described above, the elements are the same as the first embodiment. Thus, further detailed explanation is omitted as unnecessary.

The second embodiment operates as follows: When the louvers 40', 42' are oriented perpendicular to the head rail 10, as shown in FIG. 6(*b*), the open-and-close shaft 12 is rotated by operating the operating cord 13, by which the master carrier 16*a*, which has an inside lead nut 20 having a female screw portion engaged with the male screw portion of the open-and-close shaft 12, is moved in the longitudinal direction within the head rail 10. The space between the master carrier 16*a* and the next carrier 16*c* reaches the given interval d, whereupon the next carrier 16*c* is drawn by the spacer link 44. Carriers 16*b*, 16*c*, 16*b*, 16*c* . . . are successively drawn.

The carriers can be placed in the spaced position whereby the carriers are separated by the given distance d (see FIG. 6(*c*)).

When the carriers are in the spaced position, the rotation shaft 14 is rotated by operating the operation cord 15, which turns the hooks 30 and louvers 40' about their respective vertical axes so that the louvers 40' are oriented parallel to the head rail 10. Because the width of the louvers 40' is more than twice the given interval d between the carriers (as determined by spacer link 44), a louver 40' contacts the adjacent louver 42'. Louver 42', which is hung through hook 34 from the carrier 16*c* so that it can be rotated on its vertical axis, is pushed by louver 40' and turned with louvers 40' until louvers 40' and louvers 42' are oriented parallel to the head rail 10, as shown in FIG. 6(*d*). Because the width of louvers 40' is more than twice the given interval d, the adjacent louvers 40' overlap so that any space between the louvers is fully covered by opaque louvers 40'. In this manner, the opposite side of the vertical blind is shielded from view.

The rotation shafts 14 are rotated by again operating the operation cord 15, by which the louvers 40', which are oriented parallel to the head rail 10, are turned until they return to a position perpendicular to the head rail 10. As shown in FIG. 6(*e*), the louvers 42' are turned so that they slide on the surfaces of the louvers 40'. As shown in FIG. 6(*a*), the louvers 42' incline slightly against the head rail 10 and almost cover all of the space between the louvers 40' that are adjacent to both sides of the louvers 42'. Because louvers 42' are semitransparent, light from the opposite side of the vertical blind can reach the interior and one can see through the blind to the other side. Privacy, however, can be guarded to some degree because the interior of the room is not fully exposed to view through louvers 42' from the opposite side of the vertical blind.

When opening the blind, starting from the position shown in FIG. 6(*a*), the open-and-close shaft 12 is rotated in the direction opposite to the turning direction by operating the operation cord 13. The master carrier 16*a* is moved in the direction opposite to the moving direction. Thus, the expanding portions 44*a* of the spacer link 44, having one end secured to the master carrier 16*a*, are disengaged from the claw portions 46 of the next carrier 16*c*. The interval between the master carrier 16*a* and the next carrier 16*c* becomes smaller so that the master carrier 16*a* contacts the next carrier 16*c*, and pushes the next carrier 16*c* in the same direction as the moving direction of the master carrier 16*a*. In like manner, carriers 16*b*, 16*c*, . . . etc. are successively pushed until all the carriers 16 are compactly gathered at one end of the head rail 10, and are parallel to the head rail 10, as shown in FIG. 6(*b*).

The operating of the second embodiment in opening and closing the vertical blind is described in the succession of FIG. 6(*b*), ⇆FIG. 6(*c*)→FIG. 6(*d*)→FIG. 6(*e*)→FIG. 6(*a*) →FIG. 6(*b*).

Figure 7:
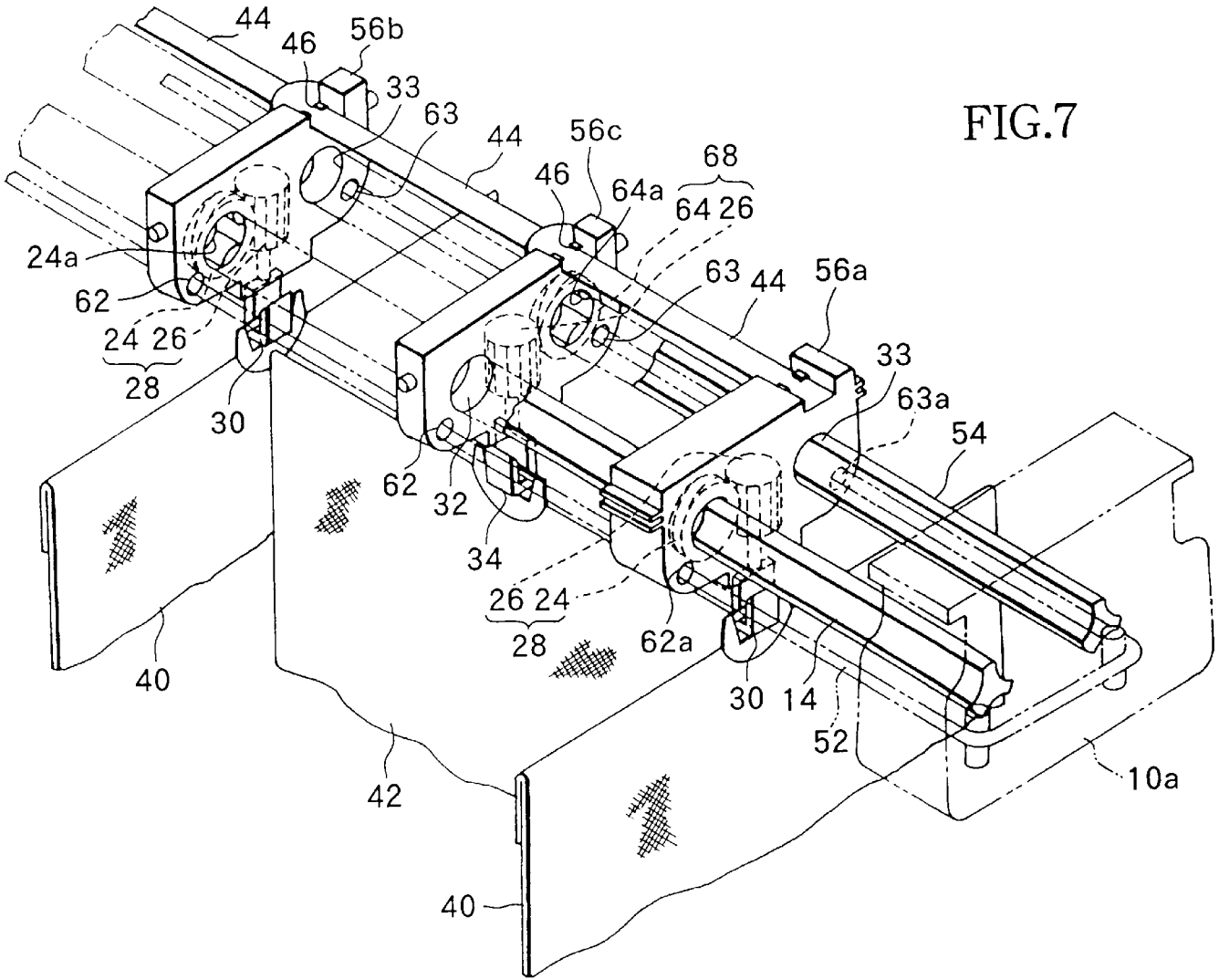
FIG. 7 is a perspective view of an important part of a third embodiment of a vertical blind of the present invention.
Figure 8:
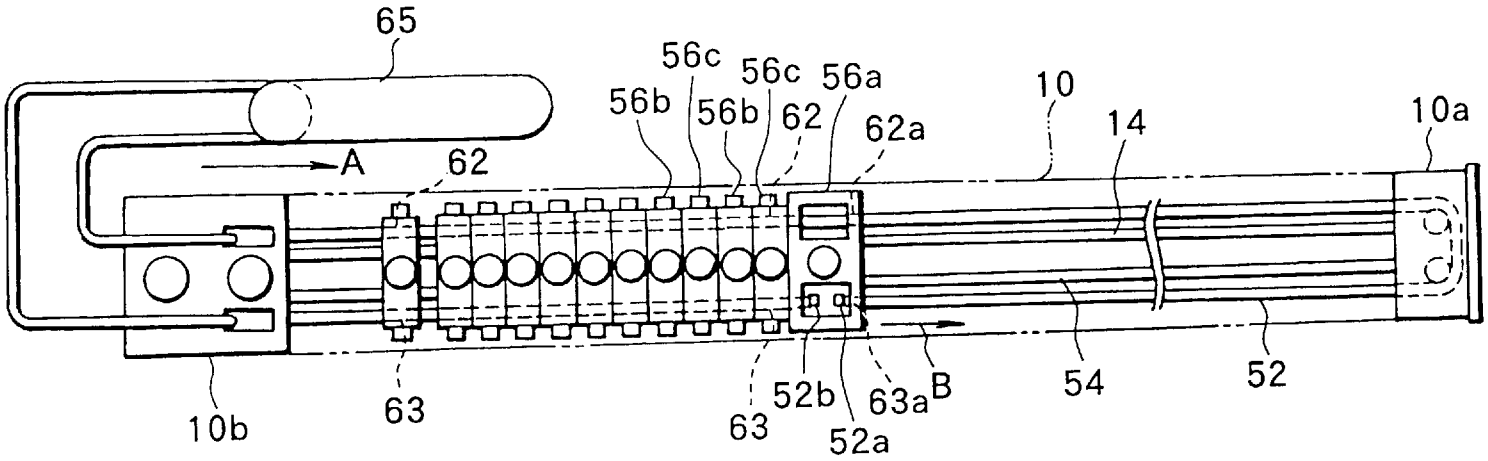
FIG. 8 is a bottom view of a portion of head rail and carriers in the third embodiment.

FIG. 7 and FIG. 8 show a third embodiment of the present invention. In this embodiment, the open-and-close shaft 12 is replaced by two rotation shafts 14, 54. The first rotation shaft 14 and the second rotation shaft 54 are supported in the head rail 10 such that they are able to rotate. The outer surfaces of both the first rotation shaft 14 and the second rotation shaft 54 are formed with three grooves, each extending in the longitudinal direction. Further, the end of the rotation shafts 14, 54, are connected with the operation wheel (not shown) that is located within the control unit 10*b*. The control unit 10*b* is mounted at the head rail 10 so that the rotation shafts 14 and 54 can be rotated by using the operation part (not shown) that is wound on the operation wheel (not shown).

A plurality of carriers are also arranged in the head rail 10 so that they can be moved in the longitudinal direction of the head rail 10. The endmost carrier of the plural carriers is a master carrier 56*a*.

Further, every alternating carrier 56*b* (first carriers), including the master carrier 56*a*, is formed with a rotation-transferring mechanism 28. The rotation-transfening mechanism includes a worm 24 with a central hole 24*a*, and a worm wheel 26. The central hole 24*a* has ribs that engage the grooves of the rotation shaft 14. The worm wheel 26 engages with the worm 24 and both are positioned inside each first carrier 56*b*. The lower part of the worm wheel 26 is connected with the hook 30 and can be rotated as one unit, which is downwardly projected from the master carrier 56*a* and the carriers 56*b*. Further, the master carrier 56*a* and the carrier 56*b* include a through hole 33 through which the rotation shaft 54 loosely passes.

None of the second carriers 56*c* have a rotation-transferring mechanism 28. The second carriers 56*c* include a hole 32 through which the rotation shaft 14 loosely passes, and a second rotation-transferring mechanism 68. The second rotation-transfening mechanism 68 includes a worm 64 that has a central hole 64*a* with ribs to engage the grooves of the rotation shaft 54, and a worm wheel 26. The worm wheel 26 engages the worm 64, both being provided inside each second carrier. The lower part of the worm wheel 26 is connected with the hook 34 and can rotate as one unit and extend downwardly from the carriers 56*c*.

Also, the master carrier 56*a* and the other carriers include plural through holes 62*a*, 63*a*, and 62, 63, respectively, through which the open-and-close cord 52 passes. As shown in FIG. 8, one end of the open-and-closed cord 52 has a point 52*a* attached to the master carrier 56*a*. The point 52*a* is located within the through hole 63*a*. The other end of the open-and-close cord 52 is directed toward the end cover 10*a* and is turned back and threads the through holes 62*a* and the through holes 62 of the carriers. The open-and-close cord 52 then advances from the control unit 10*b* and passes through the cord weight 65, and exits control unit 10*b* to thread the through holes 63 of the carriers and threads the inside of through hole 63*a* of the master carrier 56*a*. A point 52*b*. formed at the other end of open-and-close cord 52 is fixed to the inside of master carrier 56*a*.

Opaque louvers 40 are hung from alternating carriers 56*b* including master carrier 56*a* by hooks 30. Semitransparent louvers 42 are hung from the other carriers 56*c* by hooks 34.

In the present embodiment of the invention, if the louvers 40, 42 are positioned perpendicular to the head rail 10, the master carrier 56*a* can be moved toward the end cover 10*a* (in the direction of the arrow B as shown in FIG. 8), in the longitudinal direction within the head rail 10, by pulling the open-and-close cord 52. The open-and-close cord 52 is drawn from the control unit 10*b* in the direction of the arrow A, as shown in FIG. 8, so that the carriers can be spaced until they are arranged a given distance apart d.

When the carriers are arranged in this manner, the rotation shaft 54 is rotated so that the louvers 42 are turned about the vertical axis via the second rotation-transferring mechanism 68 by operating the operation part. If the louvers 42 are turned until they are parallel to the head rail and, the louvers 40 are perpendicular to the head rail 10, each space between the louvers 40 that are adjacent to either side of the louver 42, can almost be covered by each louver 42. Accordingly, light can penetrate the vertical blind and one can see through the louvers 42. However, privacy can be guarded to some degree, because the interior of the room is not fully exposed.

Further, only the louvers 40 can be rotated around their vertical axes by the rotation-transferring mechanism 28 merely by rotating the rotation shafts 14. If louvers 40 are turned until louvers 40 are parallel to the head rail 10, the adjacent louvers are oriented to overlap each other so that any space between the louvers cannot be seen from a direction perpendicular to head rail 10. Thus, the opaque louvers 40 cause the vertical blind to fully shield the interior of the room.

When opening the blind, louvers 40 are turned so that they are perpendicular to the head rail 10 by tuning the rotation shaft 14, and louvers 42 are turned until oriented perpendicular to the head rail 10 by turning the rotation shaft 54. Thereafter, if the open-and-close cord 52 is pulled in the direction opposite to the direction of the arrow A as shown in FIG. 8, the master carrier 56*a* can be moved toward the control unit 10*b*. Because the carriers are successively pushed toward the control unit 10*b*, all the carriers can be compactly gathered at one end of the head rail 10.

By having two rotation-transfening mechanisms, carriers 56*b* and carriers 56*c* can be separately operated.

Having two rotation-transfening mechanism is not restricted to the third embodiment. It is also possible to have the carriers 56*b* provided with a first rotation-transferring but have all the carriers 56*b*, 56*c* equipped with a second rotation-transferring mechanism. Or, it is also possible in the present invention to have all of the carriers 56*b*, 56*c* equipped with a first rotation-transferring mechanism, while only carriers 56*c* are provided with a second transferring mechanism.

In any case, it is necessary to maintain the louvers 40 hung from carriers 56*b* and the louvers 42 hung from carriers 56*c* at different rotation angles. In particular, where the louvers 40 hung from carriers 56*b* are oriented nearly perpendicular to the head rail 10, louvers 42 hung from carriers 56*c* can be maintained to cover almost all of the space between the adjacent louvers 40, 40, hung from carriers 56*b*, 56*b*. Further, all of louvers 40, 42 may be nearly parallel to the head rail 10 to prevent seeing inside the room. Further, all of the louvers 40, 42, may be gathered at one end of head rail 10 if they are perpendicular to the head rail 10.

Embodiments of the present invention have been described where the louvers 42 are semitransparent and the louvers 40 are opaque. However, the invention is not restricted to this. Louvers 40 can also be semitransparent. Where louvers 40 overlap louvers 42, multi layer overlapping can provide the screening effect of a vertical blind. Furthermore, it is unnecessary that both louvers 40 and louvers 42 be semitransparent. For example, louvers 40 and louvers 42 can form pleasing patterns with each other that can change by turning louvers 40 and louvers 42 at angles different to each other.

Figure 9:
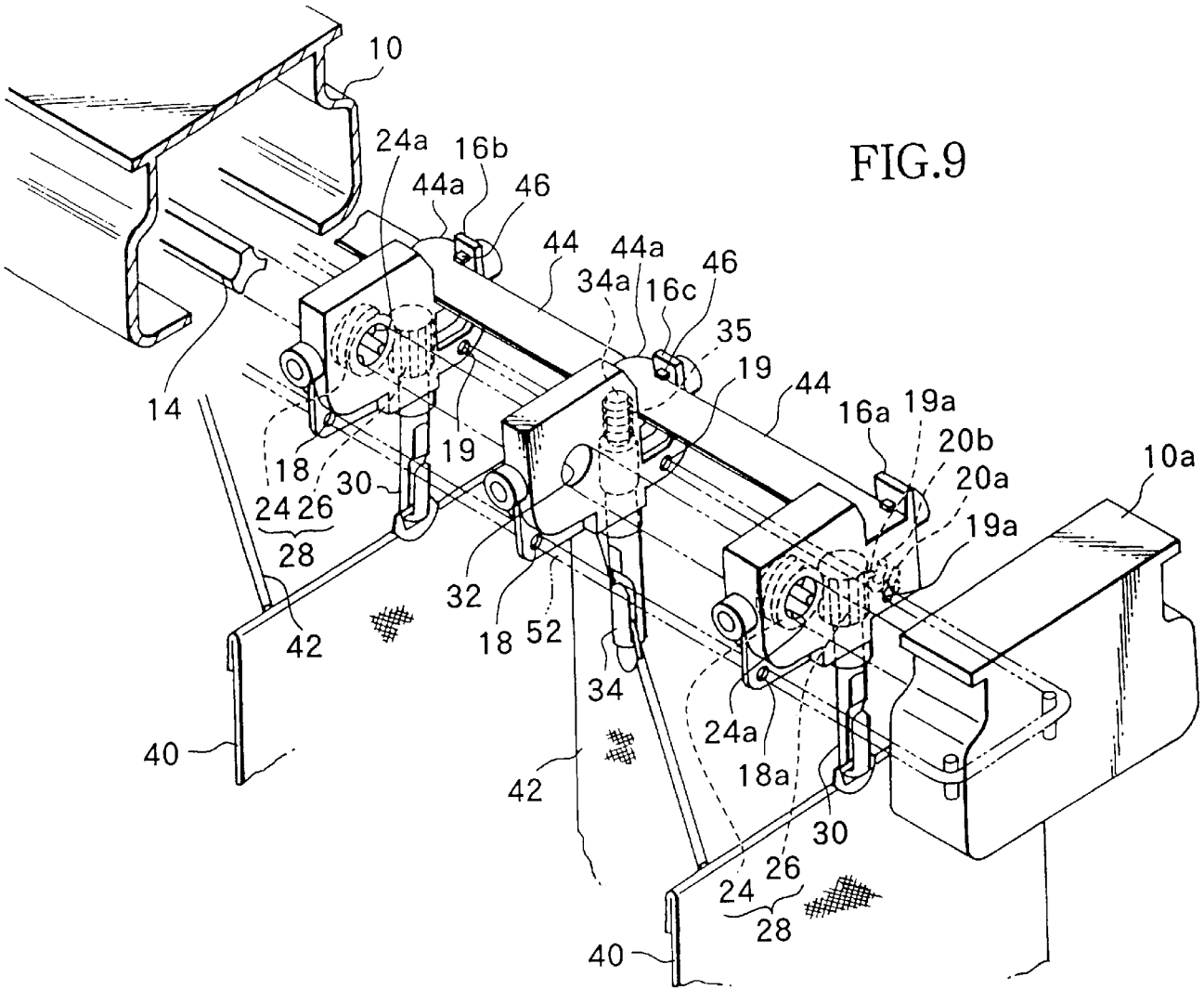
FIG. 9 is a perspective view of a part of a fourth embodiment of a vertical blind of the present invention.

Referring to FIG. 9, a fourth embodiment of the present invention is explained. FIG. 9 utilizes the same numbering of elements as used to discuss previous embodiments.

Figure 11:
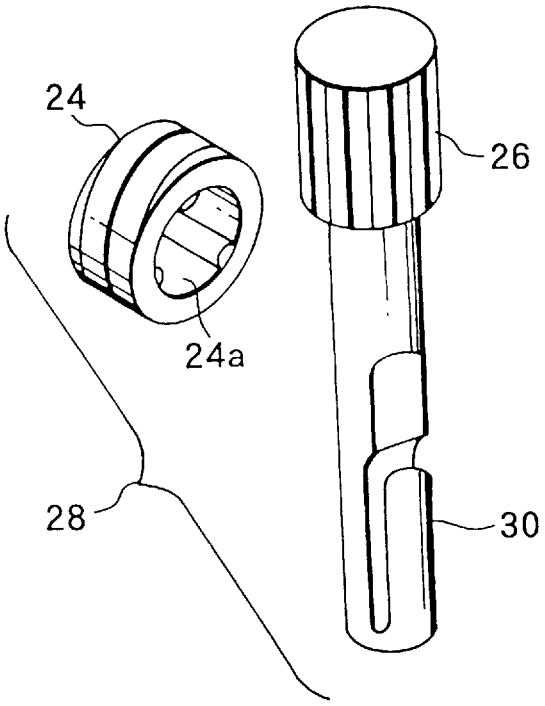
FIG. 11 is an exploded perspective view of rotation-transferring mechanism mounted in a first carrier.

As shown in FIG. 9 and FIG. 11, each of alternating carriers 16*b* (first carriers), including the master carrier 16*a*, has a rotation-transferring mechanism 28. The rotation transferring mechanism 28 includes a worm 24 which includes a central hole 24*a* and ribs to engage the grooves of the rotation shaft 14. The rotation transferring mechanism 28 flier includes a worm wheel 26 for engaging the worm 24 inside each carrier 16*b* and 16*a*. The lower part of the worm wheel 26 is integrally connected to the hook 30, which projects downward from the carriers 16*b*, 16*a*. Opaque louvers 40 are hung by hooks 30 from the master carriers 16*a* and first carriers 16*b*.

Each second carrier 16*c*, which is not equipped with a rotation-transferring mechanism 28, includes a through hole 32 through which the rotation shaft 14 loosely passes and a hook 34 that projects downwardly from the carrier 16*c* to rotate on a vertical axis.

Figure 10:
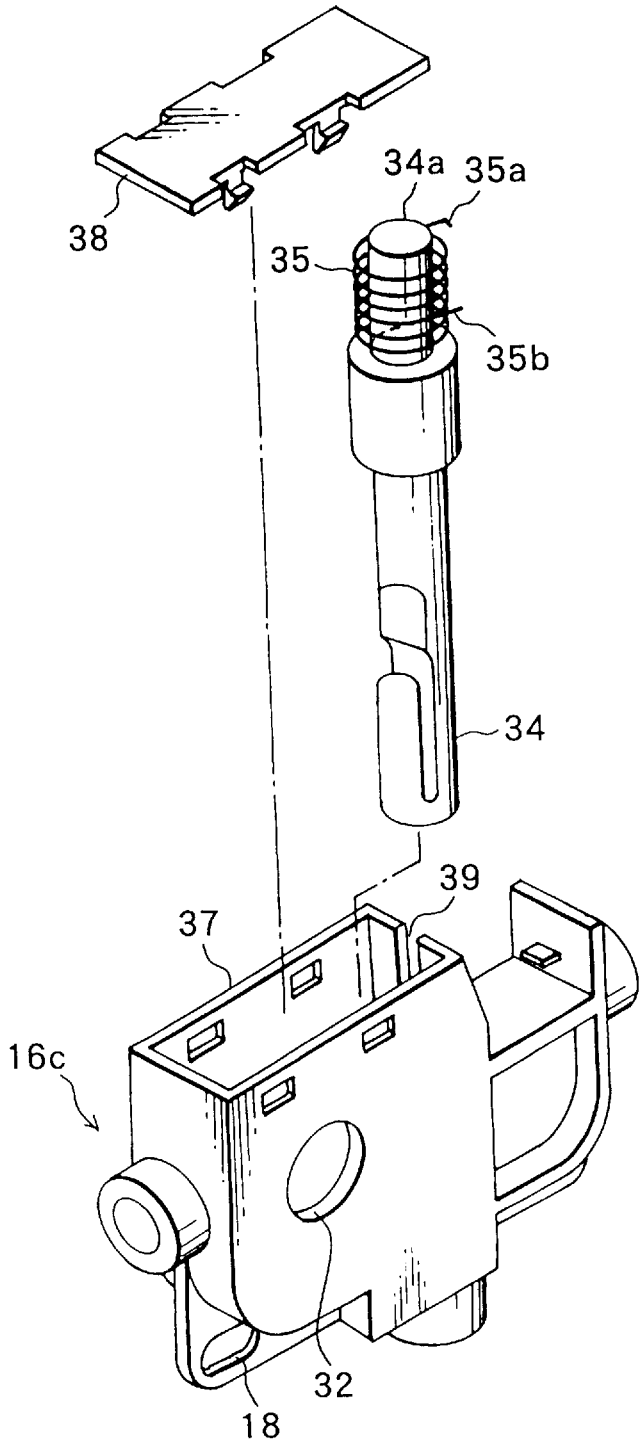
FIG. 10 is an exploded perspective view of a second carrier and hook shown in FIG. 9.

As shown in FIG. 10, the coil spring 35 serves as biasing mechanism. The coil spring 35 is mounted around the upper end of the shaft portion 34*a*. The shaft portion 34*a* extends from the upper portion of the hook 34. When the hook 34 is inserted into the frame 37, one end 35*a* of the coil spring 35 is bent into a hook-shape, and engages the vertical groove 39 that is formed in the frame 37 of the carrier 16*c*. Further, the other end 35*b* of the coil spring 35 is bent so that it crosses through the upper end shaft portion 34*a*. The carrier further includes a cover 38 for the frame 37 of the carrier 16*c*.

Semitransparent louvers 42 are hung by hooks 34 from the carriers. The hooks 35 and the louvers 42 are forced to rotate about their vertical axes in a given direction by spring force of the coil spring. When the louvers 42 are nearly parallel to the head rail 10, a stopper (not shown) that is formed within the carrier 16*c*, prevents the hooks from turning further.

Each of the carriers is connected to each other, with the master carrier 16*a* at the head, so that the carriers can maintain a certain distance apart or come close to each other, with a given maximum interval d as the maximum interval. The maximum interval d is determined by the spacer link 44.

The width of each of the opaque louvers 40 that hang from the carriers 16*b* that are equipped with a rotation-transferring mechanism 28, is chosen to be about two times or greater than two times, the given interval d between the carrier, determined by spacer link 44. The width of each semitransparent louver 42 hung from the carrier 16*c*, which have no rotation-transferring mechanism 28, is chosen to be larger than the distance between the adjacent louvers 40 where louvers 40 are nearly perpendicular to the head rail 10. Specifically, the width is determined to be more than twice the given interval d between the carriers, determined by spacer link 44.

Figure 12:
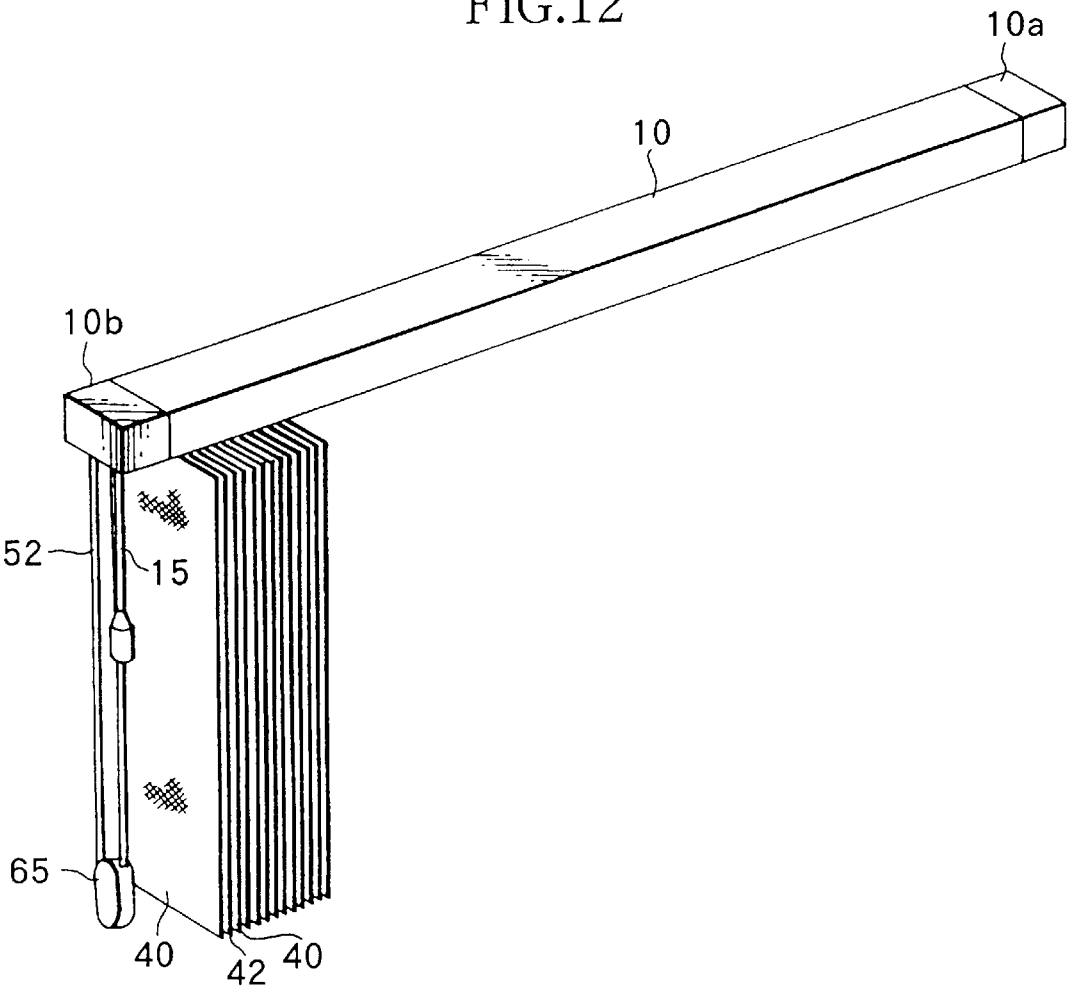
FIG. 12 is a general perspective view showing the vertical blind in FIG. 9 opened.
Figure 15:
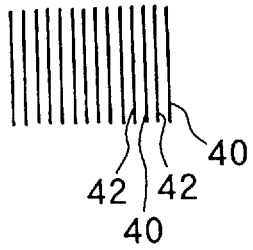
FIGS. 15(*a*), 15(*b*) and 15(*c*) are schematic plan views of louvers shown in FIGS. 12–14.
Figure 15:
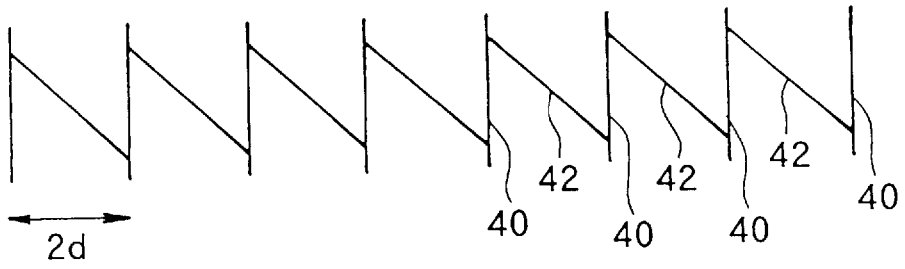
Figure 15:
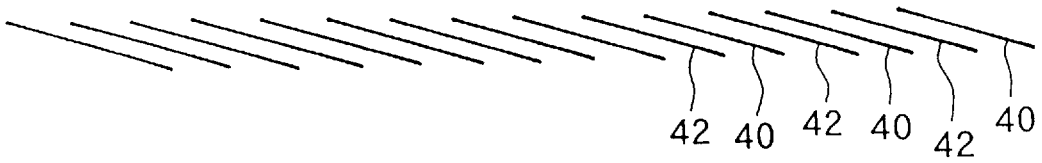

In the vertical blind constructed as discussed above, where louvers 40, 42 are gathered on the side of the head rail 10 where the control unit 10*b* is located as shown in FIG. 12 and FIG. 15(*c*), pulling the open-and-close cord 52 where it exits the control unit 10*b*, causes the master carrier 16*a* to move in the longitudinal direction within the head rail 10 toward the end cover 10*a*, since the master carrier 16*a* is attached to the point 52*b* of the open-and-close cord 52. If the distance between the master carrier 16*a* and the next carrier 16*c* becomes equal to the given interval d, then the next carrier 16*c* is pulled by the spacer link 44. The following carriers (alternating 16*b*, 16*c*) are pulled in a like manner.

Figure 13:
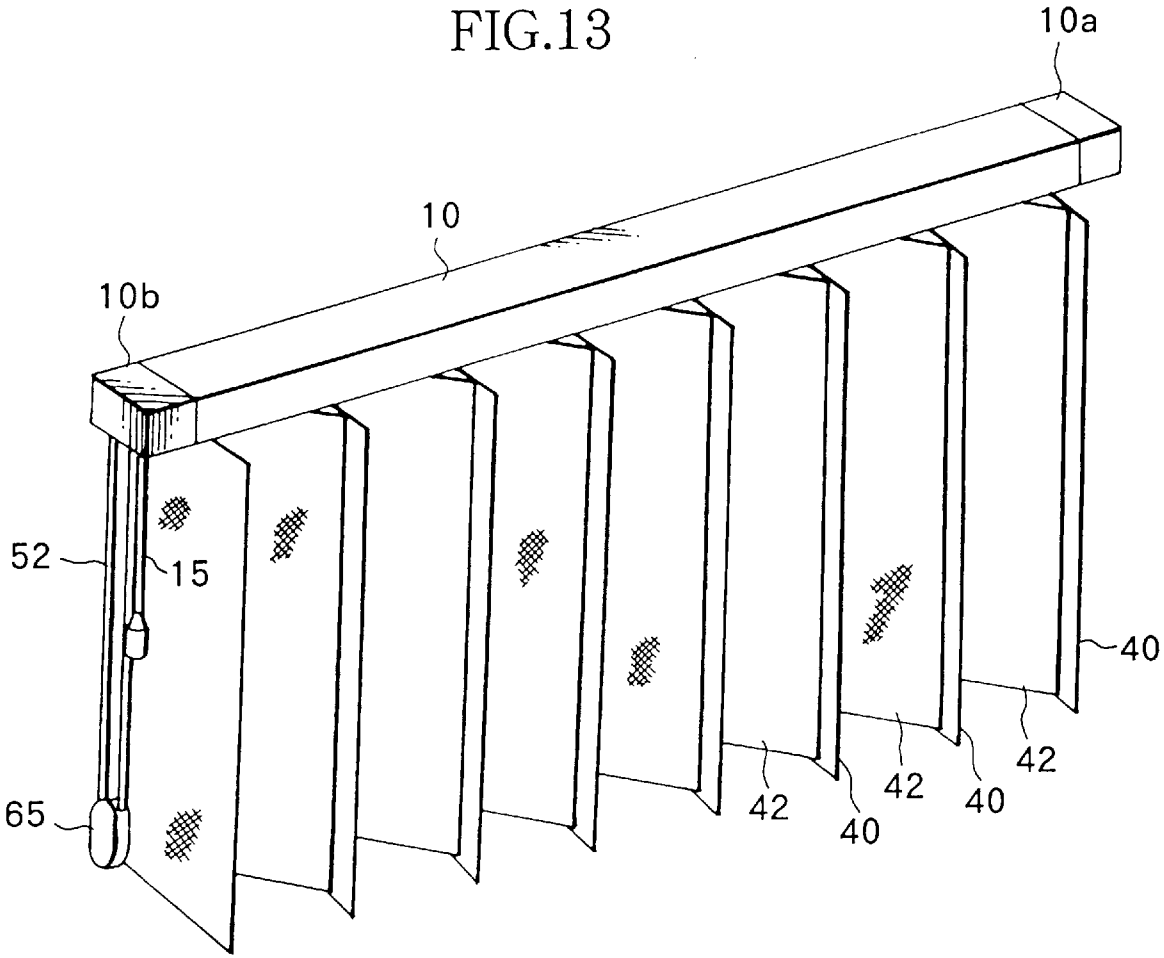
FIG. 13 is a general perspective view showing the vertical blind shown in FIG. 9 closed and the louvers hung from the first carriers are oriented perpendicular to the head rail.

As shown in FIG. 13 and FIG. 15(*b*), the carriers are placed in the spaced position when the carriers have the given interval d between them. While louvers 40, hung from carriers 16*b*, are oriented perpendicular to the head rail 10, the louvers 42 hung from carriers 16*c*, are prone to rotate around their vertical axes. As shown in FIG. 15, the coil spring 35 forces the louvers 42 in a counterclockwise direction around their vertical axes. However, because the width of the semitransparent louvers 42 is more than twice the given interval d between the carriers, the adjacent louvers 40 prevent the louvers 42 from turning. The louvers 42 are positioned to be inclined with respect to the head rail 10 to almost cover the spaces between the adjacent louvers 40. Because louvers 42 are semitransparent, light can reach the opposite side of the vertical blind, and one can see outside. Privacy can be somewhat guarded, however, because the inside of the room is not fully viewable through louvers 42.

Further, when the louver 42 hung from carrier 16*c*, which has the rotation-transferring mechanism, moves due to the wind, the rotation angle of louvers 42 about the vertical axis changes and a space is formed between the louvers 40 adjacent to louver 42. Louvers 42 can be automatically restored by the action of the coil spring 35 such that the space between the louvers 40 is almost covered again.

Figure 14:
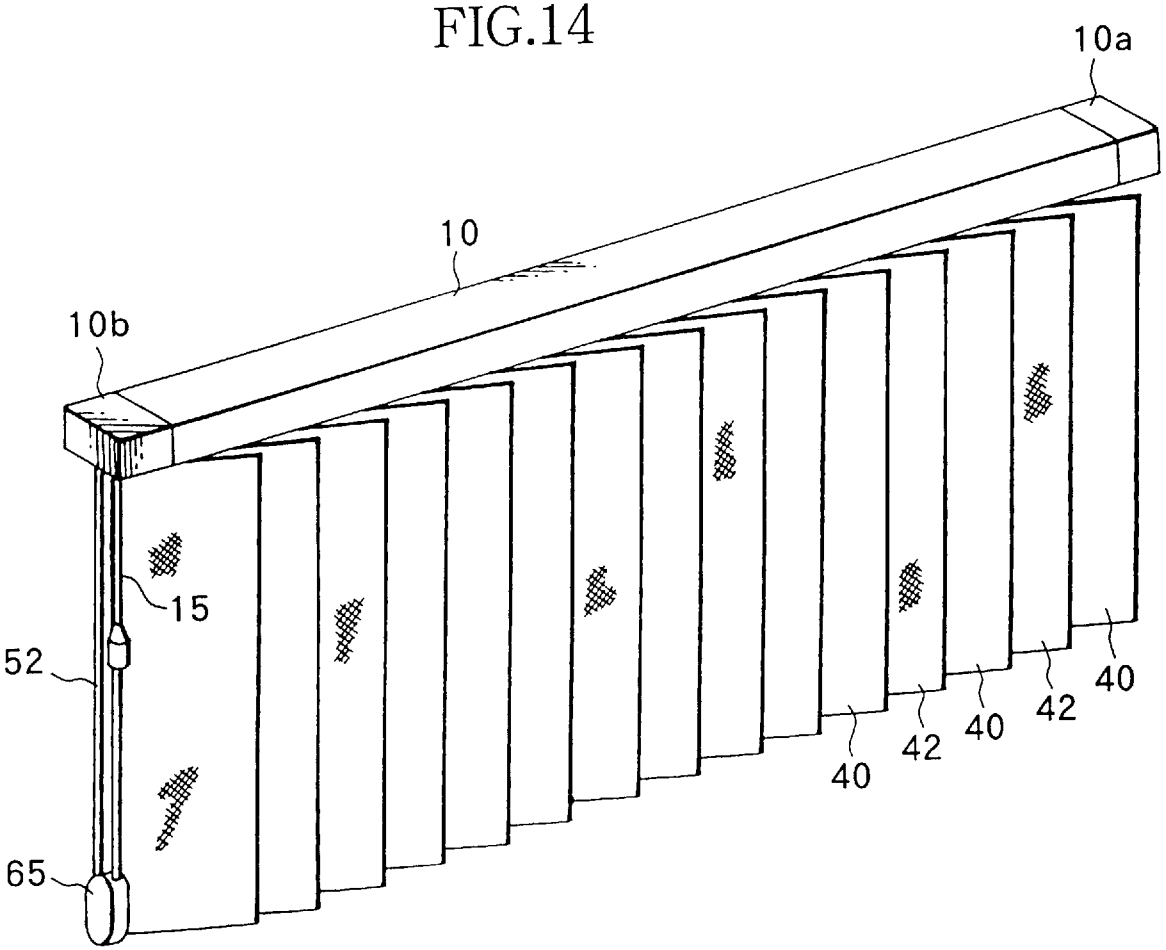
FIG. 14 is a general perspective view showing the vertical blind shown in FIG. 9 closed and all the louvers are oriented nearly parallel to the head rail.

In this embodiment, the grooves of rotation shafts 14 are rotated by operating the rotation control rod 15. The grooves of the rotation shaft engage with the rotation-transferring mechanism 28. Because only the master carrier 16*a* and the first carriers 16*b* are equipped with a rotation-transfening mechanism 28, the rotation motion transferred from the rotation shaft 14 is transferred through each rotation-transferring mechanism 28 so that each hook 30 and each louver 40 are turned about a vertical axis so that they become parallel to the head rail 10. The louvers 42, hung from second carriers 16*c*, are turned through the action of the coil spring 35 until the louvers 42 are oriented parallel to the head rail 10 as shown in FIG. 14 and FIG. 15(*c*). Because the width of each louver 40 is equal to about twice the interval d between the carriers, or larger than twice the interval d between carriers, the adjacent louvers 40 overlap so that no space between the louvers 40 can be seen from a direction perpendicular to the head rail 10. Thus, the opaque louvers 40 of the vertical blind fully prevent viewing.

Further, if louvers 40 are turned in either direction, the spaces between louvers 40 are covered by louvers 42.

When opening the blind when the louvers 40 are perpendicular to the head rail 10, if the open-and-close cord 52 is pulled in the direction opposite to the pulling direction, the master carrier 16*a*, which is attached to the point 52*b* of the open-and-close cord 52, is moved toward the control unit 10*b* in the longitudinal direction within the head rail 10. Thus, expanding portions 44*a* of the spacer links 44, each having one end secured to the master carrier 16*a*, are disengaged from the claw portions 46 of the next carrier 16*c*. The interval between the master carrier 16*a* and the next carrier 16*c* becomes smaller until the master carrier 16*a* contacts the next carrier 16*c*, and pushes the next carrier 16*c* in the same direction as the master carrier 16*a*. In the same manner, the remaining carriers 16*b*, 16*c*, are pushed in order until all of the carriers are compactly gathered at the end of head rail 10. At this time, the coil spring 35 acts on each louver 42. However, each louver 42 is restricted by the adjacent louvers 40, which are oriented perpendicular to the head rail 10. Thus, each louver 42 cannot move without striking the adjacent louvers 40. Each louver 42 is always oriented at a predetermined angle against the head rail 10.

In this embodiment, because louvers 40 and louvers 42 are maintained at different angles, the vertical blind can change shape.

Further, even if the louvers are unintentionally turned, or the turning angle of the louvers 42 is changed by the wind or the like, each louver 42 can be restored to its position whereby the space between both louvers 40 adjacent to the louvers 42 is covered by each louver 42.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention.

For example, in the above embodiments, examples including rotation shafts 14, 54 have been given. However, this invention is not restricted to this. It goes with out saying that other drivers, such as a belt, can be used.

Further, in the first and second embodiments, examples including an open-and-close shaft 12 have been given. However, it is, as a matter of course, that an open-and-close cord 52 can be used in place of the open-and-close shaft 12, explained in the third embodiment.

Further, in the fourth embodiment, an example including an open-and-close cord 52 have been explained. However, as a matter of course, to move the master carrier 16*a* in the longitudinal direction of the head rail 10, an open-and-close shaft engaged with the master carrier 16*a* can be used.

The present disclosure relates to subject matter contained in Japanese Application No. 8-212782 filed on Aug. 12, 1996, and Japanese Application No. 8-298520, filed Nov. 11, 1996, which are expressly incorporated herein by reference in their entireties.

What is claimed is:

1. A vertical blind comprising:

a head rail having a longitudinal axis;

a plurality of first carriers and a plurality of second carriers, said first and second carriers alternating along said longitudinal axis of said head rail and movable within said head rail;

a driving mechanism mounted in said head rail;

first louvers hung from corresponding first carriers said first louvers being substantially planar;

a rotation-transferring mechanism linked to each of said first carriers for transferring motion of said driving mechanism to said first louvers to rotate said first louvers about vertical axes of said first louvers between an open position nearly perpendicular to said longitudinal axis of said head rail and a closed position nearly parallel to said head rail; and second louvers hung from corresponding second carriers, said second louvers substantially closing a space between adjacent first louvers when said first louvers are in either of said open or closed position.

2. A vertical blind according to claim 1, wherein said first carriers and said second carriers are arranged such that, when said first carriers and said second carriers are spaced at predetermined intervals, said second louvers hung from said second carriers are positioned in said closed position substantially parallel to said longitudinal axis of said head rail.

3. A vertical blind according to claim 1, wherein a width of said second louvers is greater than a distance between said first louvers adjacent to said second louvers, when said first and second carriers are spaced apart as far as possible and when said first louvers are oriented in said open position substantially perpendicular to said longitudinal axis of said head rail.

4. A vertical blind according to claim 1, wherein said second louvers hung from said second carriers are semi-transparent.

5. A vertical blind according to claim 1, wherein said first louvers completely cover a space between said first louvers when said first louvers and said first carriers are oriented in said closed position substantially parallel to said longitudinal axis of said head rail.

6. A vertical blind comprising:

a head rail having a longitudinal axis;

a plurality of first and second carriers alternately spaced along the longitudinal axis and movable within said head rail;

a first driving mechanism mounted within said head rail;

first louvers hung from corresponding first carriers, said first louvers being substantially planar;

a first rotation-transferring mechanism linked to each of said first carriers for transferring the motion of said first driving mechanism to said first louvers to rotate said first louvers about vertical axes of said first louvers between an open position nearly perpendicular to said longitudinal axis of said head rail and a closed position nearly parallel to said head rail;

second louvers hung from corresponding second carriers, said second louvers substantially closing a space between adjacent first louvers when said first louvers are in either of said open or closed position;

a second driving mechanism mounted within said head rail; and a second rotation-transferring mechanism linked to each of said second carriers for transferring the motion of said second driving mechanism to said second louvers to rotate said second louvers about vertical axes of said second louvers, said second rotation-transferring mechanism being independently operable from said first rotation-transferring mechanism.

7. A vertical blind according to claim 6, wherein said second louvers hung from said second carriers are semi-transparent.

8. A vertical blind according to claim 6, wherein said first louvers completely cover a space between said first louvers when said first louvers and said carriers are oriented in said closed position substantially parallel to said longitudinal axis of said head rail.

9. A vertical blind comprising:

a head rail having a longitudinal axis;

a plurality of first carriers and a plurality of second carriers alternately spaced along the longitudinal axis of said head rail and movable within said head rail;

a first driving mechanism mounted within said head rail;

first louvers hung from corresponding first carriers, said first louvers being substantially planar;

a first rotation-transferring mechanism linked to each of said first carriers for transferring the motion of said first driving mechanism to said first louvers to rotate said first louvers about vertical axes of said first louvers between an open position nearly perpendicular to said longitudinal axis and a closed position nearly parallel to said head rail;

second louvers hung from corresponding second carriers, said second louvers substantially closing a space between adjacent first louvers when said first louvers are in either of said open or closed position;

a second driving mechanism mounted within said head rail; and a second rotation-transferring mechanism linked to each of said first carriers and said second carriers for transferring the motion of said second driving mechanism to both of said first louvers and said second louvers to rotate both of said first louvers and said second louvers about vertical axes of said first louvers and said second louvers between said open position and said closed position, said second rotation-transferring mechanism being independently operable from said first rotation-transferring mechanism.

10. A vertical blind according to claim 9, wherein said second louvers hung from said second carriers are semi-transparent.

11. A vertical blind according to claim 9, wherein said first louvers completely cover a space between said first louvers when said first first louvers and said first carriers are oriented in said closed position substantially parallel to said longitudinal axis of said head rail.

12. A vertical blind comprising:

a head rail having a longitudinal axis;

a plurality of first carriers and second carriers alternately spaced along the longitudinal axis and movable within said head rail;

a first driving mechanism mounted within said head rail;

first louvers hung from corresponding first carriers, said first louvers being substantially planar;

second louvers hung from corresponding second carriers;

a first rotation-transferring mechanism linked to each of said first and second carriers for transferring the motion of said first driving mechanism to both of said first louvers and said second to rotate both of said first louvers and said second louvers about vertical axes of said first louvers and said second louvers between an open position nearly perpendicular to said longitudinal axis and a closed position nearly parallel to said head rail;

a second driving mechanism mounted within said head rail; and a second rotation-transferring mechanism linked to each of said second carriers for transferring the motion of said second driving mechanism to said second louvers to rotate said second louvers about said vertical axes of said second louvers between said open position and said closed position, said second rotation-transferring mechanism being independently operable from said first rotation-transferring mechanism;

said second louvers hung from said second carriers substantially closing a space between adjacent first louvers when said first louvers are in either of said open or closed position.

13. A vertical blind according to claim 12, wherein said second louvers hung from said second carriers are semi-transparent.

14. A vertical blind according to claim 12, wherein said first louvers completely cover a space between said first louvers when said first louvers and said first carriers are oriented in said closed position substantially parallel to said longitudinal axis of said head rail.

15. A vertical blind comprising:

a head rail having a longitudinal axis;

a plurality of first carriers and a plurality of second carriers, said first and second carriers alternating along the longitudinal axis of said head rail and movable within said head rail;

a driving mechanism mounted within said head rail;

first louvers hung from corresponding first carriers;

second louvers hung from corresponding second carriers; and a rotation-transferring mechanism linked to each of said first carriers for transferring the motion of said driving mechanism to only said first louvers to rotate said first louvers about vertical axes of said first louvers so that said first louvers rotate independently of said second louvers.

16. A vertical blind according to claim 15, wherein said second louvers hung from said second carriers are semi-transparent.

17. A vertical blind according to claim 15, wherein said first louvers hung from said first carriers completely cover a space between said first louvers hung from said first carriers when said first louvers and said first carriers are oriented in a closed position substantially parallel to said longitudinal axis of said head rail.

18. A vertical blind comprising:

a head rail having longitudinal axis;

a plurality of first and second carriers alternately spaced along the longitudinal axis and movable within said head rail;

a driving mechanism mounted within said head rail;

first louvers hung from corresponding first carriers, said first louvers being substantially planar;

a rotation-transferring mechanism linked to each of said first carriers for transferring the motion of said driving mechanism to said first louvers to rotate said first louvers about vertical axes of said first louvers between an open position nearly perpendicular to said longitudinal axis and a closed position nearly parallel to said head rail;

second louvers hung from corresponding second carriers, said second louvers substantially closing a space between adjacent first louvers when said first louvers are in either of said open or closed position;

a forcing mechanism mounted within said each second carrier for resiliently biasing said second louvers in a predetermined turning direction about vertical axes of said second louvers.

19. A vertical blind according to claim 18, wherein a width of each of said second louvers is greater than a distance between said first louvers adjacent to said second louvers when said first and second carriers are spaced apart as far as possible and when said first louvers are oriented in said open position substantially perpendicular to said longitudinal axis of said head rail.

20. A vertical blind according to claim 18, wherein said second louvers hung from said second carriers are semi-transparent.

21. A vertical blind according to claim 18, wherein said first louvers completely cover a space between said first louvers when said first louvers and said first carriers are oriented in said closed position substantially parallel to said longitudinal axis of said head rail.

22. A vertical blind comprising:

a head rail;

carriers arranged along said head rail;

first louvers and second louvers hung from corresponding carriers, said first and second louvers alternating along the length of said head rail;

a driving mechanism for rotating only said first louvers to vary a rotated position of said first louvers;

said second louvers together substantially intercepting sufficient light incident on said blind to provide privacy independently of the rotated position of said first louvers.

* * * * *

UNITED STATES PATENT AND TRADEMARK OFFICE

CERTIFICATE OF CORRECTION

PATENT NO. : 5,865,234

DATED : February 2, 1999

INVENTOR(S) : H. NAKAMURA et al.

It is certified that error appears in the above-identified patent and that said Letters Patent is hereby corrected as shown below:

At column 16, line 27 (claim 1, line 8) of the printed patent, after "carriers" insert ",".

At column 18, line 3 (claim 11, line 3) of the printed patent, change "first first louvers" to ---first louvers---.

At column 18, line 19 (claim 12, line 13) of the printed patent, insert ---louvers--- after "second".

Signed and Sealed this

Twenty-ninth Day of February, 2000

*Attest:*

*Attesting Officer*

Q. TODD DICKINSON

*Commissioner of Patents and Trademarks*